United States Patent [19]

Pressnall et al.

[11] Patent Number: 4,901,652

[45] Date of Patent: Feb. 20, 1990

[54] ACCUMULATING AND CONVEYING INCINERATOR ASH

[75] Inventors: Dale W. Pressnall, Tulsa; John R. Petersen, Jr., Pawnee; Michael R. Keller, Tulsa, all of Okla.

[73] Assignee: John Zink Company, Tulsa, Okla.

[21] Appl. No.: 335,958

[22] Filed: Apr. 10, 1989

[51] Int. Cl.[4] ..... F23G 5/00; F23G 7/00

[52] U.S. Cl. ..... 110/259; 110/165 R

[58] Field of Search ..... 110/259, 265 R, 168, 110/171, 346, 235, 233

[56] References Cited

U.S. PATENT DOCUMENTS

| | | | |
|---|---|---|---|
| 4,723,494 | 2/1988 | Kerr | 110/259 |
| 4,798,150 | 1/1989 | Pressnall et al. | 110/171 |
| 4,840,130 | 6/1989 | Quiel | 110/165 X |

*Primary Examiner*—Edward G. Favors

*Attorney, Agent, or Firm*—Laney, Dougherty, Hessin & Beavers

[57] ABSTRACT

Improved methods and apparatus for accumulating and conveying hot ash produced by an incinerator are provided. The method is comprised of the steps of continuously conducting hot ash from the incinerator to a closed oscillating housing which includes first and second compartments. The compartments are connected by an internal door for sealingly isolating the first compartment from the second compartment, and the second compartment has an ash discharge door connected thereto for sealingly isolating both the first and second compartments when the internal door therebetween is open. The oscillating housing is continuously operated in cycles whereby the ash conducted to the first compartment is accumulated therein and conveyed over the floor thereof to the second compartment, and the ash received in the second compartment is conveyed over the floor thereof and discharged therefrom without air infiltration from the housing to the incinerator taking place.

17 Claims, 3 Drawing Sheets

ACCUMULATING AND CONVEYING INCINERATOR ASH

BACKGROUND OF THE INVENTION

1. Field Of The Invention

The present invention relates generally to methods and apparatus for incinerating combustible wastes, and more particularly, to improved methods and apparatus for accumulating and conveying the hot ash continuously produced in an incineration system.

2. Description of the Prior Art

The incineration of solids such as municipal refuse produces hot ash which must be accumulated, cooled and conveyed from the incineration system to a point of disposal. A commonly utilized incineration system includes a wastes incinerator, such as a rotary kiln, wherein the wastes are combusted to produce combustion gases and hot ash. The hot ash is conducted by gravity from the kiln to associated accumulating and conveying apparatus.

Various types of accumulating and conveying apparatus have been utilized heretofore. One such prior art apparatus is comprised of a water tank having a slanted side. A chain conveyor system is mounted within the tank against the slanted side for collecting ash which is dropped into the tank and water contained therein from the wastes incinerator. The hot ash is quenched by the water and then settles to the bottom of the tank from where it is conveyed up the slanted surface of the tank and into a disposal hopper, another conveyor or the like.

A variety of problems are encountered in the use of ash accumulating and conveying apparatus of the type described above. While the water tank is generally arranged with respect to the incinerator to provide a liquid seal which prevents air infiltration into the incinerator, the hot ash causes steam to be produced which backflows into the incinerator reducing its efficiency. The steam also causes slag to build up in both the incinerator and the ash handling apparatus. In addition, such water tank conveying systems readily break down as a result of the abrasive and non-uniform nature of the ash.

Another prior art ash accumulating and conveying system utilizes one or more valves in association with a conveyor. The hot ash from the incinerator flows by gravity through a conduit to a valve and is allowed to build up thereon. The valve is periodically opened whereby the ash falls therefrom onto a conveyor or onto a second valve. When a second valve is used, the top valve is closed followed by opening of the second valve to minimize air infiltration to the incinerator. However, even where two valves are used, air leakage into the incinerator takes place causing disruptions in the incinerator operation. In addition, the heat transferred to the valves from the hot ash causes distortion of the valve seats and other parts which along with the abrasiveness of the ash produces frequent breakdowns and maintenance.

By the present invention improved methods and apparatus for accumulating and conveying hot ash in an incinerator system are provided which obviate the above-mentioned problems associated with air and/or steam infiltration to the incinerator, slag buildup, valve failures, etc.

SUMMARY OF THE INVENTION

Improved methods and apparatus for accumulating and conveying ash produced in an incineration system are provided. The term "ash" is used herein to mean both hot ash and slagging ash which produces solid slag when cooled. In accordance with the method of the invention, hot ash from a waste incinerator is continuously conducted to the floor of a closed oscillating conveyor apparatus. The apparatus includes first and second compartments connected by an internal door for sealingly isolating the first compartment from the second compartment. The floor of the second compartment communicates with the floor of the first compartment, and a discharge door is connected to the second compartment for sealingly isolating both the first and second compartments when the internal door therebetween is open.

The oscillating conveyor apparatus is continuously cyclically operated whereby the ash conducted to the first compartment is accumulated therein and conveyed over the floor thereof to the second compartment, and ash received in the second compartment is conveyed over the floor thereof and discharged therefrom without air in filtration from the ash accumulator and conveyor apparatus to the incinerator taking place. Each operating cycle of the apparatus comprises oscillating the apparatus with the internal door thereof closed and the ash discharge door open in a manner whereby ash contained in the second compartment is conveyed towards the discharge door end thereof and discharged therefrom. The discharge door is closed followed by the opening of the internal door, and the conveyor apparatus is oscillated whereby ash is moved from the first compartment into the second compartment. The internal door is then closed and the discharge door opened, and the cycle is repeated.

In a preferred embodiment, the oscillating accumulator and conveyor apparatus is continuously cooled which in turn brings about the partial cooling of the ash. Upon being discharged from the conveyor apparatus, the partially cooled ash can be readily further cooled to the required handling temperature by spraying the ash with water or other similar means.

Because the ash does not contact any moving valve parts, conveyor parts or other similar parts which can become abraded or jammed, the accumulator and conveyor apparatus of this invention is much less prone to break down and requires greatly reduced maintenance as compared to prior art apparatus. In order to prevent the internal door and the ash discharge door of the apparatus from being clogged with ash whereby complete closure and sealing are prevented, the oscillations of the apparatus are reversed just prior to closing such door whereby ash is caused to be conveyed in the opposite direction out of contact with and away from sealing surfaces contacted by the doors when closed.

It is, therefore, a general object of the present invention to provide an improved method and apparatus for accumulating and conveying hot ash in an incinerator system.

Another object of the present invention is the provision of a method and apparatus for continuously accumulating and conveying hot incinerator ash without allowing the infiltration of air and/or steam into the incinerator.

A further object of the present invention is the provision of apparatus for accumulating and conveying incinerator ash of the oscillating conveyor type which brings about the partial cooling of the ash as it is being accumulated and conveyed.

Other and further objects, features and advantages of the present invention will be readily apparent to those skilled in the art upon a reading of the description of preferred embodiments which follows when taken in conjunction with the accompanying drawings.

DETAILED DESCRIPTION OF PREFERRED EMBODIMENTS

Figure 1:
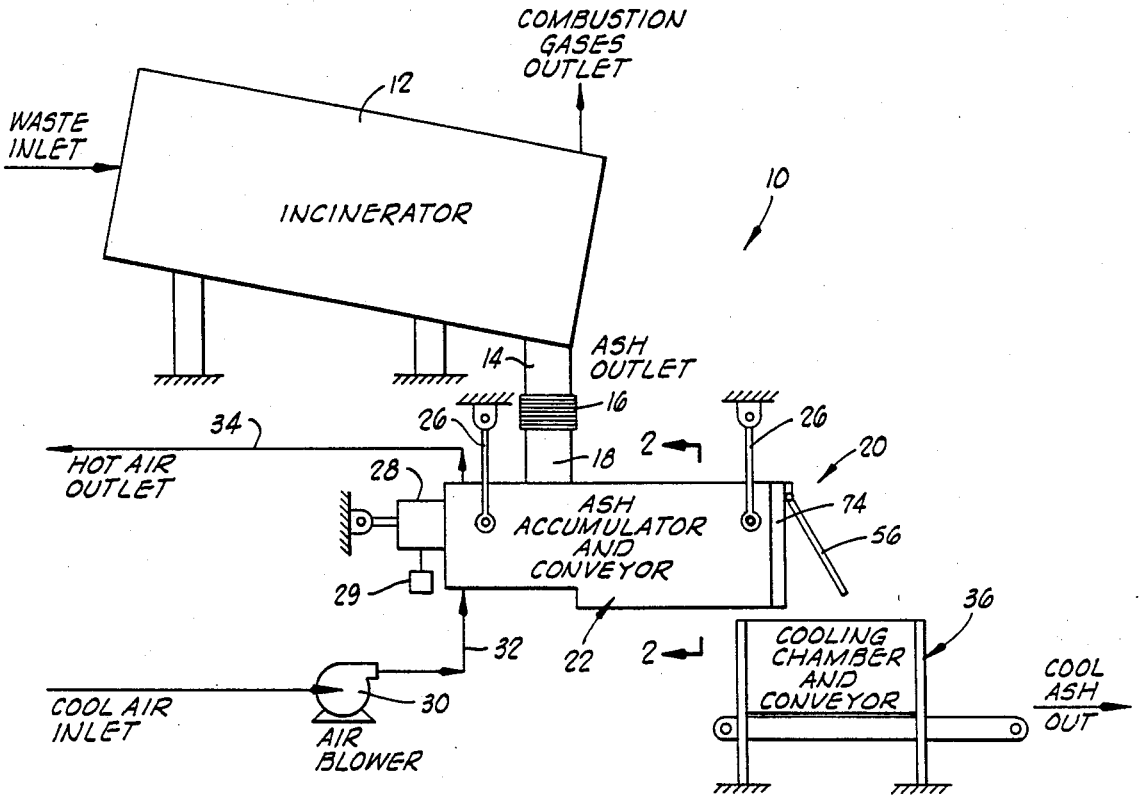
FIG. 1 is a side, partially schematic view of a waste incineration system including the ash accumulator and conveyor apparatus of the present invention.

Referring now to the drawings, and particularly to FIG. 1, an incineration system which includes the ash accumulator and conveyor apparatus of the present invention is illustrated and generally designated by the numeral 10. The system 10 includes a conventional incinerator 12 such as a rotating kiln, which includes a waste inlet, a combustion gases outlet and a hot ash outlet connected to a conductor pipe 14. An expansion and oscillation absorbing fitting 16 is connected to the pipe 14 and to an ash conduit 18. The ash conduit 18 is in turn connected to the ash accumulator and conveyor apparatus of the present invention, generally designated by the numeral 20. The apparatus 20 is comprised of a closed housing 22 having an inlet for receiving hot ash connected to the conduit 18, and having an ash discharge door 56 connected thereto. The housing 22 is movably suspended by a plurality of pivotal arms 26, and an oscillator 28 for oscillating the housing 22 is connected thereto at the opposite end thereof from the ash discharge door 56. The oscillator 28 functions to reciprocate the housing 22 in directions parallel to the longitudinal axis thereof, i.e., the oscillator 28 swings the housing 22 to and fro on the pivotal arms 26.

As will be understood by those skilled in the art, the oscillation of the housing 22 functions to cause ash deposited on the internal floors thereof to be conveyed in directions parallel to the directions of movement of the housing 22. That is, the housing 22 is oscillated by applying thereto successive reciprocal movements in and opposite to the direction of conveyance of the ash, each movement opposite to the direction of conveyance being quick whereby the ash slips on the floor of the housing with each movement in the direction of conveyance being slow whereby no slippage occurs. For example, when ash is conveyed from the end portion of the housing 22 to which the oscillator 28 is attached to the opposite discharge end thereof, the oscillator 28 oscillates the housing 22 in successive reciprocal movements whereby each movement in the direction opposite the direction of conveyance of the ash is quick and each movement in the direction of conveyance of the ash is slow. During the quick movement the ash is caused to slide on the floor of the housing a distance approximately equal to the length of the quick movement, and during the slow reverse movement the ash does not slide on the floor of the housing. Successive such reciprocal rectilinear movements cause the ash to be conveyed in the direction of the slow movement. The oscillator 28 includes a control 29 for reversing the directions of quick and slow movements whereby the ash can be conveyed in opposite directions within the housing 22.

As will be described in more detail hereinbelow, the floors and top walls of the housing 22 are constructed whereby cooling media ducts for cooling the floors and top walls are formed. The discharge of a cooling air blower 30 is connected by a conduit 32 to the inlet of the ducts in the housing 22, and a conduit 34 is connected to the outlet of such ducts. While air is the cooling medium described herein, it will be understood by those skilled in the art that other available cooling media can be used, e.g., water, heat transfer oil, etc.

A cooling chamber including an integral conveyor 36 is disposed immediately below the discharge end of the housing 22 whereby ash discharged from the housing 22 falls by gravity into the cooling chamber and onto the conveyor thereof. The ash entering the cooling chamber is cooled such as by means of a water spray, and the conveyor conveys the cooled ash to a location from where it is moved to a point of use or disposal.

In operation of the system 10, hot ash and/or slagging ash produced in the incinerator 12 flows by gravity through the outlet pipe 14, the expansion joint 16 and the conduit 18 into the housing 22. The housing 22 is oscillated as described above whereby the ash is continuously accumulated and conveyed therewithin and discharged therefrom in a manner such that air is prevented from backflowing to the incinerator 12. Cooling air is circulated through the ducts formed in the housing 22 whereby the housing 22 is continuously cooled, and as a result, the ash accumulated and conveyed therewithin is also partially cooled. The partially cooled ash discharged from the apparatus 20 is further cooled within the cooling chamber and conveyor 36 as described above.

Figure 2:
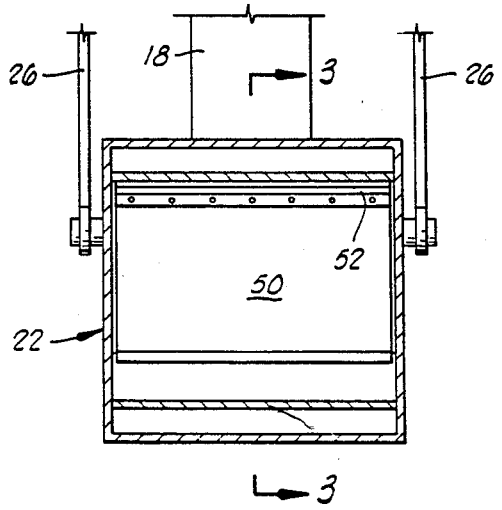
FIG. 2 is a cross-sectional view taken along line 2—2 of FIG. 1.
Figure 3:
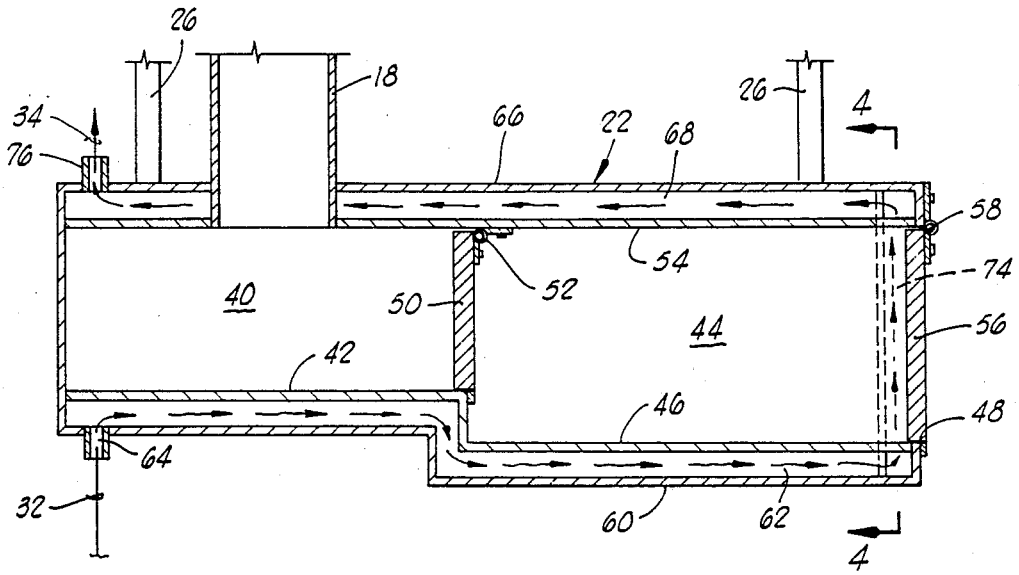
FIG. 3 is a cross-sectional view taken along line 3—3 of FIG. 2.
Figure 4:
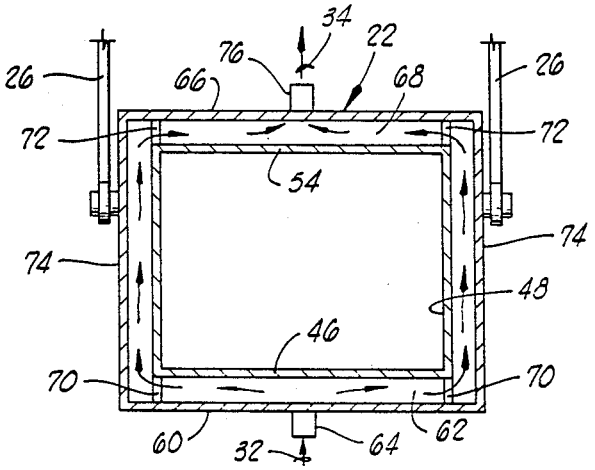
FIG. 4 is a cross-sectional view taken along line 4—4 of FIG. 3.

Referring now to FIGS. 2–4, the housing 22 of the accumulator and conveyor apparatus 20 is illustrated in detail. The housing 22 includes a first closed compartment 40 into which the hot ash from the conduit 18 falls and accumulates. The first compartment 40 includes a horizontal floor 42 upon which the hot ash is deposited and over which the ash is conveyed. A second compartment 44 is provided within the housing 22 which is positioned adjacent the first compartment 40 and which includes a horizontal floor 46. The floor 46 of the second compartment 44 communicates with, but is offset below, the floor 42 of the first compartment 40. That is, ash conveyed over the floor 42 of the first compartment into the second compartment 44 is caused to fall downwardly a distance onto the floor 46 of the second compartment 44. Ash conveyed over the floor 46 of the second compartment 44 is discharged from the housing 22 by way of a discharge opening 48 at the end of the second compartment 44.

An internal door 50 is hingedly connected within the housing 22 between the first and second compartments 40 and 44 therein. As best shown in FIGS. 2 and 3, the door 50 can be hinged to the housing 22 by a hinge 52 attached to the top wall 54 of the housing 22. Conventional means for opening and closing the door 50 (not shown) are connected thereto. In a like manner, an ash discharge door 56 is hingedly attached over the ash discharge opening 48 by a hinge 58 attached to the housing 22, and conventional means (not shown) for opening and closing the door 56 are connected thereto. The internal door 50 and the ash discharge door 56 are of shapes and constructions such that when they are closed, air leakage into the conveyor housing 22 and into the incinerator 12 to which the housing 22 is connected is substantially eliminated.

Figure 11:
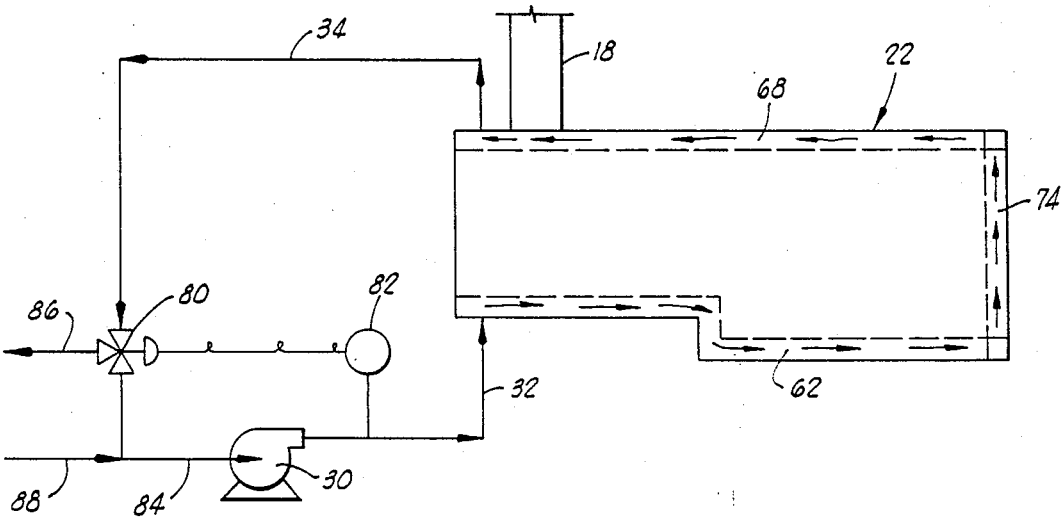
FIG. 11 is a schematic illustration showing a preferred air cooling system utilized to cool the ash accumulator and conveyor apparatus as well as ash contained therein.

Referring still to FIGS. 2–4, and also to FIG. 11, the housing 22 includes a panel 60 connected thereto which is complementary to and spaced a distance from the exterior surfaces of the floors 42 and 46 whereby a continuous duct 62 is formed thereover. The duct 62 causes air introduced therein by way of an inlet connection 64 connected at one end thereof to contact and circulate over the exterior surfaces of the floors 42 and 46 of the first and second compartments 40 and 44, respectively. In a like manner a panel 66 is connected to the top of the housing 22 forming a similar duct 68 adjacent the exterior surface of the top wall 54 of the housing 22. At the end of the housing 22 adjacent the ash discharge door 56, opposite side openings 70 are provided in the housing 22 which communicate with the duct 62 and opposite side openings 72 are provided therein which communicate with the duct 68. A pair of channels 74 positioned on opposite sides of the housing 22 are sealingly connected over opposite openings 70 and 72. Thus, as shown by the arrows in FIGS. 3 and 4, cooling air introduced into the duct 62 by way of the inlet connection 64 flows through the duct 62 and over the exterior surfaces of the floors 42 and 46, through the opposite openings 70, through the channels 74, through the openings 72 to within the duct 68, through the duct 68 and then through the outlet connection 76 connected to the duct 68. As will be understood, the circulation of cooling air through the duct 62, channel 74 and duct 68 causes the floors 42 and 46 of the first and second compartments 40 and 44, respectively, as well as the entire housing 22 to be cooled. Such cooling of the housing 22, and particularly the cooling of the floors 42 and 46, brings about the cooling of ash accumulated on and conveyed over the floors 42 and 46.

FIG. 11 illustrates a preferred arrangement of the air blower 30 and conduits 32 and 34 connected to the inlet and outlet connections 64 and 76, respectively. A stream of cooling air generated by the blower 30 is conducted by the conduit 32 to the duct 62. The air flows through the duct 62, through the channels 74, and through the duct 68 whereby the air is heated and the conveyor housing 22 and ash contained therein are cooled. The hot air exiting the duct 66 is conducted by the conduit 34 to a three-way valve 80 operably connected to a temperature controller 82. The temperature controller 82 senses the temperature of the air discharged from the blower 30 and controls the valve 80 so that a portion of the hot air flowing through the conduit 34 is caused to recirculate to the inlet of the pump 30 by way of a conduit 84 connected thereto. Excess hot air is discharged by the three-way valve 80 to the atmosphere by way of a conduit 86 connected thereto, and cool atmospheric air is drawn into the conduit 84 by way of a conduit 88 connected thereto. Thus, the temperature controller 82 can be set to control the temperature of the cooling air flowing to the conveyor housing 22 at a desired level. This, in turn, controls the temperature of the partially cooled ash being discharged from the conveyor housing 22 at a desired level. Generally, the ash being discharged from the housing 22 is controlled at a temperature in the range of from about 300° F. to about 600° F. so that acids and other corrosive substances present with the ash do not condense while the ash is within the housing 22.

Referring now to FIGS. 5–10, the operation of the oscillator 28, the internal door 50 and the ash discharge door 56 to accumulate and convey ash without allowing the infiltration of air is illustrated. As will be understood by those skilled in the art, the operation of the oscillator 28 and doors 50 and 56 can be controlled manually. However, in a preferred embodiment, a control system and associated automatic operators (not shown) are utilized to continuously cycle the oscillation of the housing 22 and the opening and closing of the doors 50 and 56.

Figure 5:
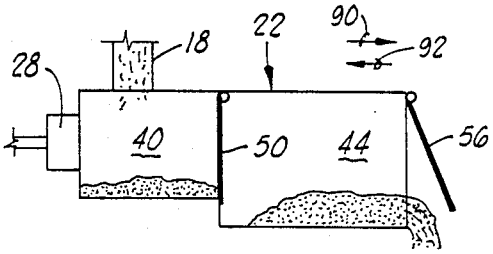
FIGS. 5–10 are schematic illustrations of the ash accumulator and conveyor apparatus in various modes of operation during an operating cycle.
Figure 6:
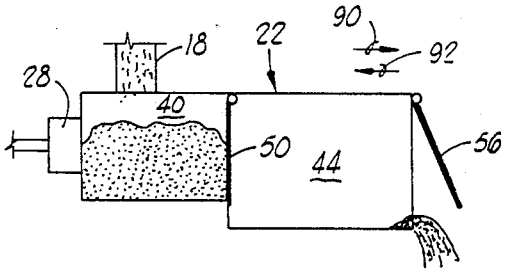
Figure 7:
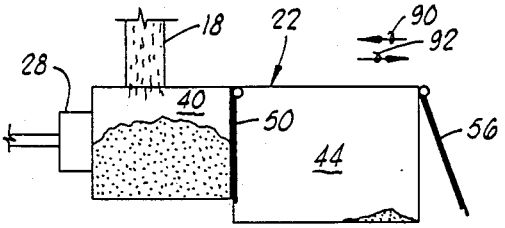
Figure 8:
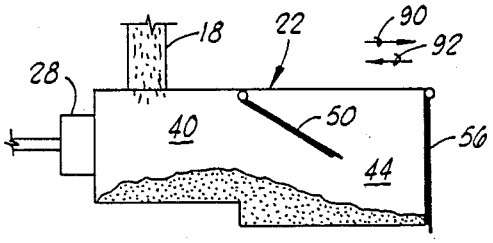
Figure 9:
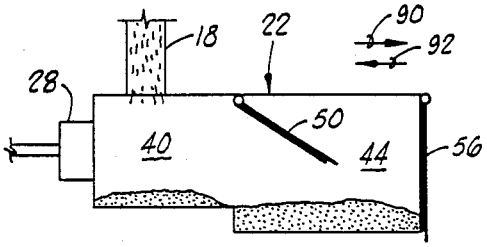
Figure 10:
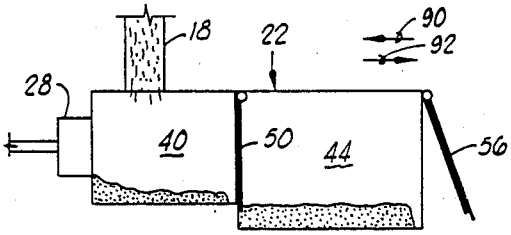

As shown in FIG. 5, at the beginning of each operating cycle, the internal door 50 is closed, the ash discharge door 56 is open, and the oscillator 28 is operating so that the housing 22 is moved in the direction of the arrow 90 in a slow movement and in the direction of the arrow 92 in a quick movement. This causes ash within the second compartment 44 to be conveyed towards and through the open discharge door 56. As shown in FIG. 6, ash continues to accumulate in the first compartment 40 as the ash is being discharged from the second compartment 44. Once the discharge of the ash from the second compartment 44 is completed and as shown in FIG. 7, the oscillation of the housing 22 is reversed. That is, the movement of the conveyor housing 22 in the direction shown by the arrow 90 is a slow movement, and the movement in the opposite direction as shown by the arrow 92 is a quick movement. The reversal of the oscillation causes ash remaining in the areas of sealing surfaces contacted by the discharge door 56 when closed to be conveyed away from such sealing surfaces. As shown in FIG. 8, the discharge door 56 is then closed, followed by the opening of the internal door 50. The oscillation of the housing 22 is reversed whereby the movement of the housing in the direction shown by the arrow 90 is slow with the movement in the opposite direction as shown by the arrow 92 being quick. This causes the ash accumulated within the first compartment 40 to be conveyed into the second compartment 44. Once a substantial portion of the ash from the first compartment 40 has been moved into the second compartment 44 as shown in FIG. 9, the oscillator 28 is again reversed so that ash is conveyed away from sealing surface areas contacted by the internal door 50 when closed. The offset between the floor in the first compartment 40 and the floor in the second compartment 44 prevents the ash in the compartment 44 from being conveyed back into the first compartment 40. As shown in FIG. 10, the internal door 50 is then closed, the discharge door 56 is opened and the cycle is repeated.

As will now be understood, the internal door 50 prevents atmospheric air from flowing through the housing 22 and into the incinerator to which it is connected while ash contained within the second compartment 44 is being discharged therefrom. The discharge door 56 prevents such flow of atmospheric air when the internal door 50 is opened and ash is being conveyed from the first compartment 40 into the second compartment 44.

This prevention of air flow into the incinerator allows the incinerator to be operated in a smooth continuous manner without disruption.

Thus, the present invention is well adapted to carry out the objects and attain the ends and advantages mentioned as well as those inherent therein. While numerous changes in the method steps and in the construction and arrangement of apparatus components can be made by those skilled in the art, such changes are encompassed within the spirit of this invention as defined by the appended claims.

What is claimed is:

1. An improved method of accumulating and conveying hot ash produced by an incinerator comprising:

continuously conducting said hot ash from said incinerator to the first compartment of a closed oscillating accumulator and conveyor apparatus, said apparatus including first and second compartments having floors for conveying ash connected by an internal door for sealingly isolating said first compartment from said second compartment, and said second compartment having an ash discharge door connected thereto for sealingly isolating both said first and second compartments when said internal door therebetween is open; and continuously operating said oscillating conveyor apparatus in cycles whereby said ash conducted to said first compartment is accumulated therein and conveyed over the floor thereof to said second compartment, and ash received in said second compartment is conveyed over the floor thereof and discharged therefrom without air infiltration from said apparatus to said incinerator taking place, each of said operating cycles comprising:

(a) with said internal door closed and said discharge door open, oscillating said conveyor apparatus in a manner whereby ash contained therein is moved towards the discharge door end of said second compartment and is discharged therefrom;

(b) closing said discharge door and then opening said internal door;

(c) oscillating said conveyor apparatus whereby ash is moved from said first compartment into said second compartment; and (d) closing said internal door and then opening said discharge door preparatory to repeating said cycle.

2. The method of claim 1 wherein the ash-conveying floor of said second compartment is offset below the ash conveying floor of said first compartment.

3. The method of claim 2 wherein the oscillations of said conveyor apparatus during steps (a) and (c) of said operating cycle are comprised of successive reciprocal movements in and opposite to the direction of conveyance of said ash, each movement opposite to the direction of conveyance being quick with each movement in the direction of conveyance being slow.

4. The method of claim 3 wherein said operating cycle is further characterized to include the steps of reversing the oscillations of said conveyor apparatus just prior to steps (b) and (d) for time periods sufficient to convey ash contained therein away from sealing surfaces contacted by said internal door and said discharge door when closed.

5. The method of claim 1 which is further characterized to include the step of cooling said apparatus whereby said ash being accumulated and conveyed thereby is also cooled.

6. The method of claim 5 wherein said step of cooling said apparatus comprises circulating air into contact with and over the exterior surfaces of said ash conveying floors of said apparatus.

7. The method of claim 5 wherein said ash is cooled to a temperature in the range of from about 300° F. to about 600° F.

8. Oscillating apparatus for accumulating and conveying hot ash produced by an incinerator comprising:

a closed housing having first and second compartments therein, an inlet for receiving hot ash into said first compartment, communicating ash-conveying floors in said compartments and an ash discharge opening for discharging ash from said second compartment;

an internal door hingedly connected within said housing between said first and second compartments for sealingly isolating said first compartment from said second compartment;

an ash discharge door hingedly connected to said housing over said ash discharge opening for sealingly isolating both said first and second compartments when said internal door between said compartments is open; and oscillating means connected to said housing for oscillating said housing whereby when said internal door is closed and said discharge door is open, said ash is accumulated in said fast compartment and conveyed and discharged from said second compartment by way of said discharge opening, and when said internal door is open and said discharge door is closed, said ash is conveyed from said first compartment into said second compartment.

9. The apparatus of claim 8 wherein said ash-conveying floor of said second compartment is offset below said ash-conveying floor of said first compartment.

10. The apparatus of claim 9 which is further characterized to include control means connected to said oscillating means for reversing the oscillations of said housing whereby said ash can be conveyed away from sealing surfaces contacted by said internal door and said discharge door when closed prior to closing such doors.

11. The apparatus of claim 8 which is further characterized to include cooling means for cooling said housing connected thereto whereby said housing and the ash being accumulated and conveyed therein are cooled.

12. The apparatus of claim 11 wherein said cooling means are comprised of:

duct means for conducting air into contact with and over the exterior surfaces of said ash-conveying floor of said housing; and air blower means connected to said duct means.

13. An incinerator system comprising:

an incinerator for incinerating combustible wastes having a wastes inlet, a combustion gases outlet and a hot ash outlet;

a conduit for conducting hot ash connected to said hot ash outlet of said incinerator; and an ash accumulator and conveyor connected to said conduit comprising:

a closed housing having first and second compartments therein, an inlet connected to said conduit for receiving hot ash into said first compartment, communicating ash-conveying floors in said compartments and an ash discharge opening for discharging ash from said second compartment;

an internal door hingedly connected within said housing between said first and second compartments for sealingly isolating said first compartment from said second compartment;

an ash discharge door hingedly connected to said housing over said ash discharge opening for sealingly isolating both said first and second compartments when said internal door between said compartments is open; and oscillating means connected to said housing for oscillating said housing whereby when said internal door is closed and said discharge door open, said ash is accumulated in said first compartment and conveyed and discharged from said second compartment by way of said discharge opening, and when said internal door is open and said discharge door is closed, said ash is conveyed from said first compartment into said second compartment.

14. The apparatus of claim 13 wherein said ash conveying floor of said second compartment is offset below said ash-conveying floor of said first compartment.

15. The apparatus of claim 14 which is further characterized to include control means connected to said oscillating means for reversing the oscillation of said housing whereby said ash can be conveyed away from sealing surfaces contacted by said internal door and said discharge door when closed prior to closing such doors.

16. The apparatus of claim 13 which is further characterized to include cooling means for cooling said housing connected thereto whereby said housing and the ash being accumulated and conveyed therein are cooled.

17. The apparatus of claim 16 wherein said cooling means are comprised of:

duct means for conducting air into contact with and over the exterior surfaces of said ash-conveying floors of said housing; and air blower means connected to said duct means.

* * * * *